United States Patent [19]

Richardson

[11] 4,188,739

[45] Feb. 19, 1980

[54] MAGNETIC SWITCH ADJUSTING SYSTEM

[75] Inventor: Warner G. Richardson, Joliet, Ill.

[73] Assignee: Caterpillar Tractor Co., Peoria, Ill.

[21] Appl. No.: 916,022

[22] Filed: Jun. 15, 1978

[51] Int. Cl.[2] ..... E02F 5/00; H01H 9/00

[52] U.S. Cl. ..... 37/126 AE; 200/61.58 R; 335/205

[58] Field of Search ..... 335/2, 17, 56, 148, 335/164, 185, 186, 205, 196–198, 200, 202, 192, 194, 195, 191, 189; 37/124 R, 126 R, 126 AE, 129; 214/88; 200/82 R–82 E, 61.58 R, 61.62, 61.72, 61.73; 56/170

[56] References Cited

U.S. PATENT DOCUMENTS

| | | | |
|---|---|---|---|
| 2,190,303 | 2/1940 | Wantz | 335/192 X |
| 2,924,682 | 2/1960 | Winterburn | 335/205 X |
| 3,158,709 | 11/1964 | Findley et al. | 335/185 |
| 3,462,569 | 8/1969 | Schooley | 335/205 X |
| 3,596,021 | 7/1971 | Saul | 335/205 X |
| 3,613,036 | 10/1971 | Kurtz | 335/196 |
| 3,613,037 | 10/1971 | Kurtz | 335/196 |
| 3,887,098 | 6/1975 | Brundige et al. | 335/205 X |

*Primary Examiner*—E. H. Eickholt
*Attorney, Agent, or Firm*—William B. Heming

[57] ABSTRACT

A work vehicle has a frame, a movable first member, a first magnetic switch portion connected to the first member, and a second magnetic switch portion connected to the frame. Apparatus is provided for pivotally connecting the second magnetic switch portion to the frame. The second magnetic switch portion generally vertically moves in response to movement of the first member and is maintained a preselected distance from the first member for assuring relative positioning of the switch portions.

8 Claims, 3 Drawing Figures

MAGNETIC SWITCH ADJUSTING SYSTEM

BACKGROUND OF THE INVENTION

In the use of a magnetic switch, it is desirable that the magnet and actuatable portions of the switch be maintained a substantially constant, preselected distance apart to facilitate proper actuation.

Magnetic switches are used on work vehicles to perform functions initiated when two members of the vehicle are in a specific relative position, one to the other. In order to achieve proper switch performance, the distance between the switch portions at the time of actuation must be closely maintained. Due to wear and/or movement of the members on which the switch is mounted, this distance is sometimes changed. Variations in manufacture can also result in improper spacing of the rigidly mounted switches.

One example is in the movable floor assembly of a scraper. It is desirable to have a kick-out switch to neutralize the opening valve of the floor controls when the floor is in a substantially open position. Magnetic switch portions are mounted on the carriage of the floor assembly and on the frame to perform the function. Movement and/or wear of the frame and floor assembly caused by the harsh working conditions of a scraper can change the spacing between the switch portions at the passing position of one switch portion relative to the other. This can result in a poorly functioning or non-functioning switch. The resultant need for the scraper operator to neutralize the valve manually in response to switch malfunction represents a waste of time and labor. Therefore, it is desirable to provide means for automatically, controllably maintaining a preselected distance between the two magnetic switch portions during use of the vehicle.

SUMMARY OF THE INVENTION

According to the present invention, means are provided for pivotally connecting a second magnetic switch portion to a frame for generally vertical movement of the second switch portion in response to movement of a first member and for maintaining the second switch portion a preselected distance from the first member.

DETAILED DESCRIPTION

Figure 1:
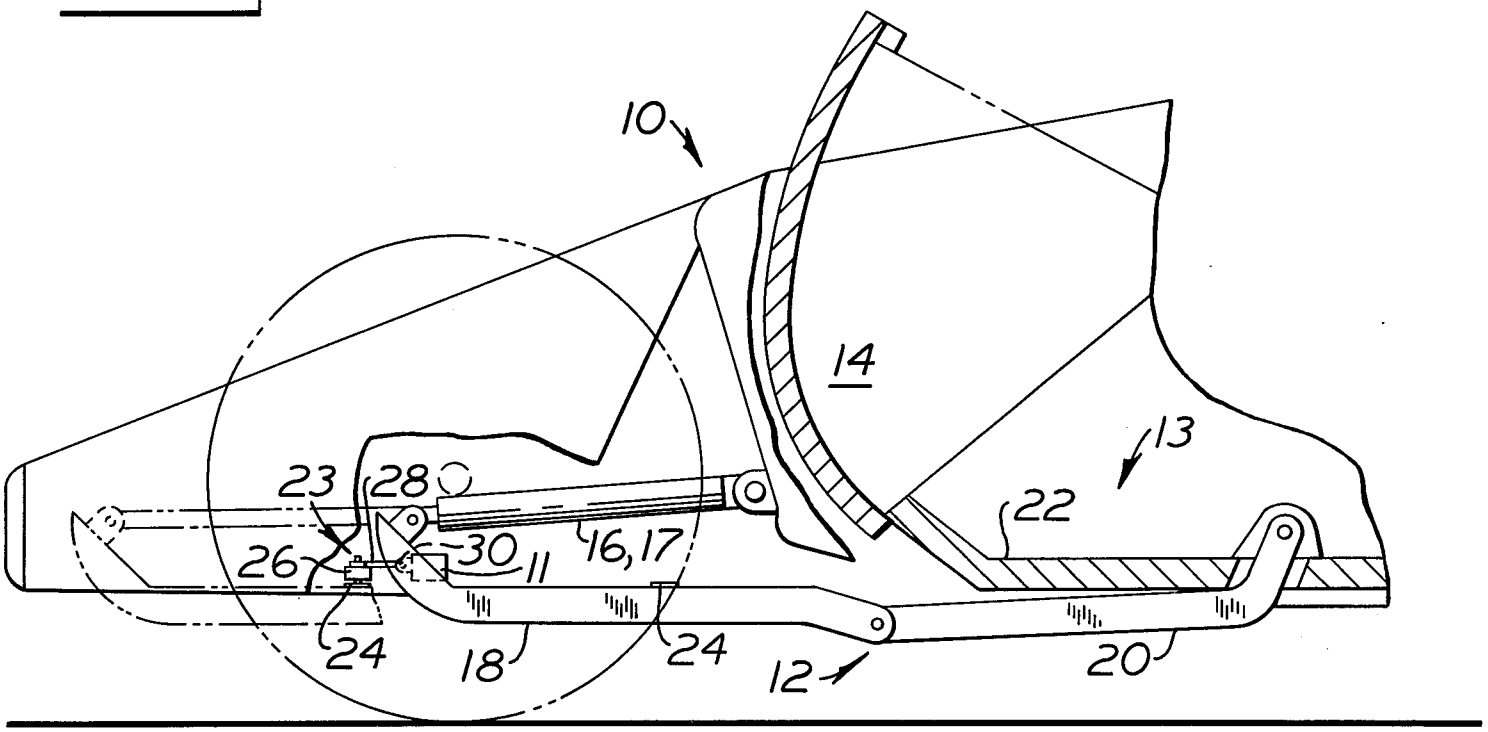
FIG. 1 is a diagrammatic view of the invention on a floor assembly of a scraper.

Referring to FIG. 1, a scraper 10 has a frame portion 11, movable floor assembly 12, floor opening 13, and a bowl 14. The movable floor assembly 12 has double-acting hydraulic cylinders 16,17, movable first member or carriage 18, connecting link 20 and a movable floor 22. The floor 22 is movable from a closed position (shown), at which the floor opening 13 is covered by the floor 22, and an open position at which said floor 22 is spaced from said opening 13. The hydraulic cylinders 16,17 are extendable and act on the carriage 18 and connecting link 20 to move the floor 22 to an open position. The cylinders 16,17 are retractable to close the floor opening 13. Such a floor assembly 12, floor opening 13, bowl 14 and controlling hydraulic cylinders 16,17 are well known in the scraper art and are utilized for containing and discharging material loads.

Figure 2:
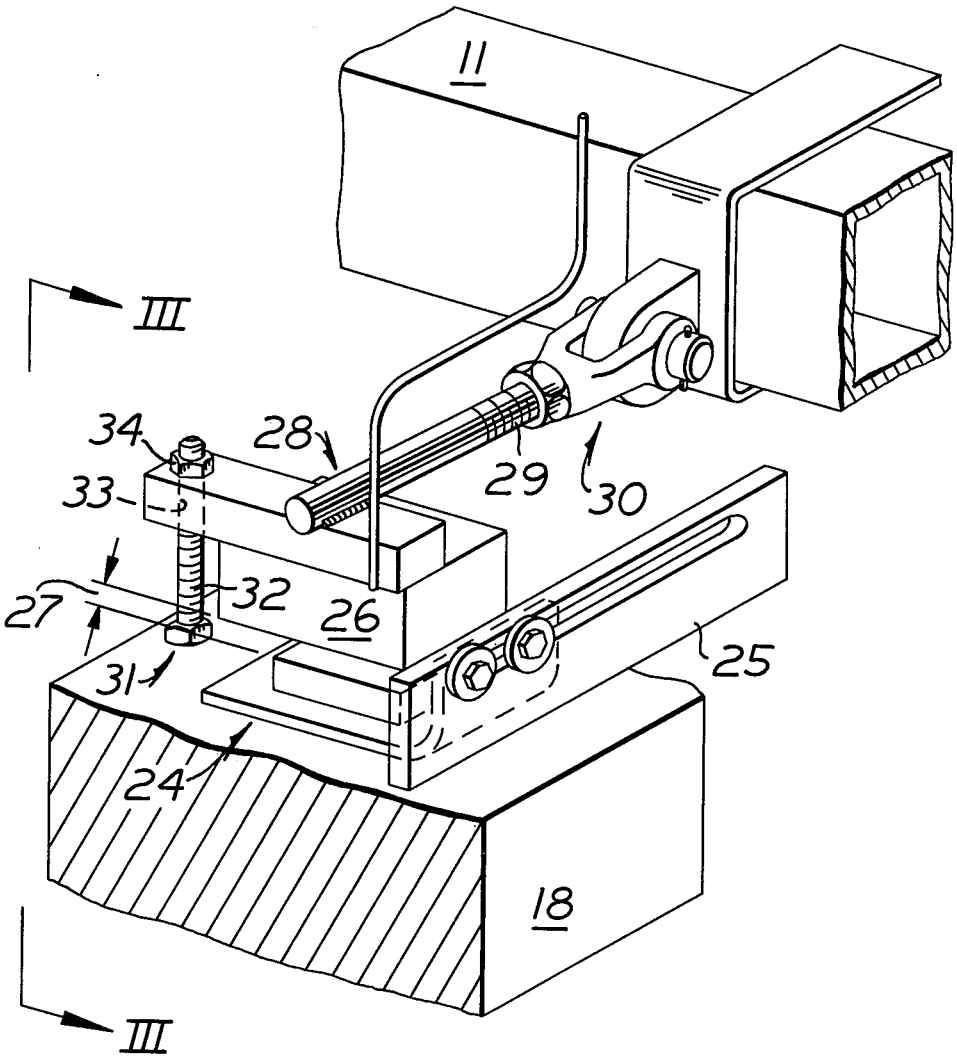
FIG. 2 is a diagrammatic perspective view showing the invention in greater detail.
Figure 3:
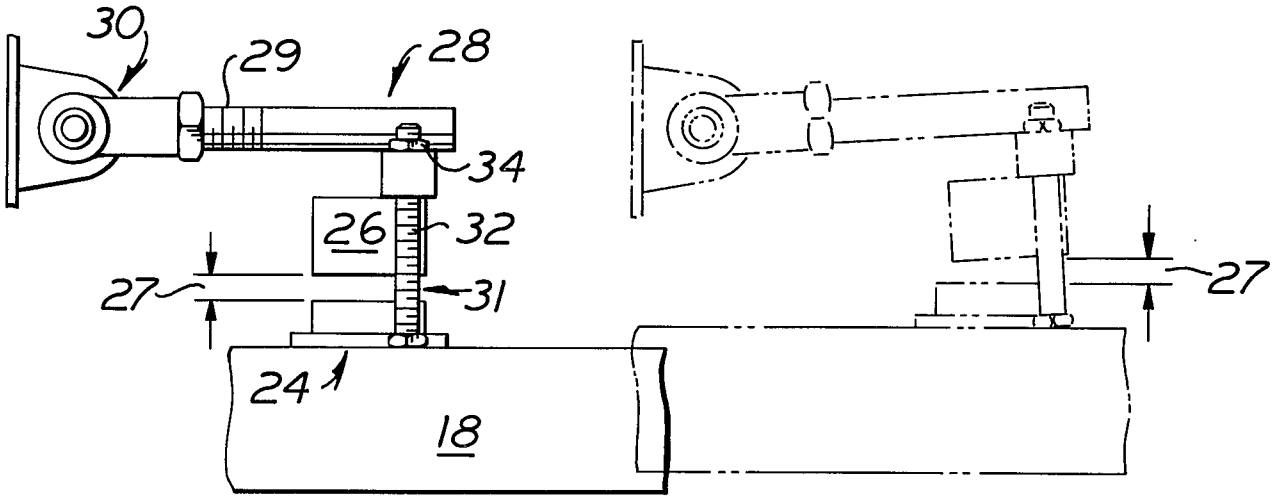
FIG. 3 is a diagrammatic view taken along line III—III of FIG. 2 showing the invention in still greater detail relative to vertical displacement of a carriage portion of the floor assembly of the scraper.

Referring also to FIGS. 2 and 3, a first magnetic switch portion 24 is connected to the carriage 18 by an adjustable bracket 25. Means 23 pivotally connects a second magnetic portion 26 to the frame 11 and maintains said switch portion 26 a preselected distance 27 from the carriage 18.

As shown, the second magnetic switch portion 26 is connected to an adjustable lever arm 28 and the lever arm 28 is connected to the frame 11 by a pivot joint 30. The second switch portion 26 can be controllably spaced a preselected distance from the frame 11 by adjusting means 29 on the lever arm 28. A spacing arm 31 is provided to maintain the second magnetic portion 26 a preselected distance 27 from the carriage 18. The arm 31 is connected at one end to the lever arm 28 and is in slidable contact with the carriage 18 at the other end. Means 32, such as threads, are provided for adjusting the spacing arm 31 to maintain the switch portion 26 a preselected distance 27 from the carriage 18. As shown, the spacing arm 31 can be a bolt 31 mateable with a threaded opening 33 in the lever arm 28 and having a lock nut 34 for maintaining the bolt at a desired position.

The first and second magnetic switch portions 24,26 define a magnetic proximity switch. Preferably, the first and second switch portions 24,26 are a magnet 24 and an actuatable portion 26, respectively. However, the switch portions 24,26 can be reversed, with the magnet portion being the first switch portion 24.

OPERATION

In the operation of the magnetic switch adjusting system, the spacing arm 31 is in slidable contact with the moving carriage 18, causing generally vertical movement of the second magnetic switch portion 26 and lever arm 28 in response to movement of the carriage 18. Therefore, change in distance between the second magnetic portion 26 and carriage 18, from wear or movement in the carriage 18, is substantially overcome.

For example, when the scraper floor 22 is moved from the closed position to an open position, the hydraulic cylinders 16,17 are extended and the carriage 18 is moved toward the rear of the scraper 10.

The arm 31 is in slidable contact with the moving carriage 18. This establishes the desired distance between the magnet 24 connected to the carriage 18 and the actuatable portion 26 connected to the lever arm 28. The pivot joint 30 permits generally vertical movement of the actuatable portion 26 in response to movement and/or wear of the carriage 18 and due to the force of gravity (FIG. 3).

The preselected distance 27 is maintained as the carriage 18 continues to move. Portion 26 is actuated when the magnet 24 on the carriage 18 is opposite said portion 26 and at the proper maintained distance. This automatically neutralizes the floor opening control valve (not shown) and the opening movement is terminated.

Other aspects, objects and advantages of this invention can be obtained from a study of the drawings, the disclosure and the appended claims.

The embodiments of the invention in which an exclusive property or privilege is claimed are defined as follows:

1. In a work vehicle having a frame, a movable first member, a first magnetic switch portion connected to the first member and a second magnetic switch portion connected to the frame, the improvement comprising:

means for pivotally connecting the second magnetic switch portion to the frame for generally vertical movement of the second switch portion in response to movement of the first member and for maintaining said second switch portion spaced a preselected distance from said first member in response to said pivotal movement of said second switch portion.

2. A work vehicle, as set forth in claim 1, wherein the means includes:

a lever arm having first and second end portions and being pivotally connected at the second end portion to the frame, said first end portion of the lever arm being generally vertically movable in response to gravity and movement of the first member;

said second magnetic switch portion being connected to the first end portion of the lever arm; and a spacing arm having first and second end portions and being connected at the first end portion to the first end portion of the lever arm, said second end portion of the spacing arm being in slidable contact with the first member.

3. A work vehicle, as set forth in claim 2, wherein the lever arm includes adjusting means for controllably positioning the second magnetic switch portion in spaced relation from the frame.

4. A work vehicle, as set forth in claim 2, wherein the spacing arm includes adjusting means for controllably positioning and maintaining the second magnetic switch portion a preselected distance from the first member.

5. A work vehicle, as set forth in claim 2, wherein the work vehicle is a scraper having a bowl, movable floor assembly and floor opening, and the first member is a carriage of the movable floor assembly of the scraper bowl, said floor assembly having a floor, said floor being movable between a closed position at which said floor is covering said floor opening and an open position at which said floor is spaced from said floor opening.

6. A work vehicle, as set forth in claim 2, wherein the first and second magnetic switch portions are a magnet and actuatable portion, respectively.

7. A work vehicle, as set forth in claim 2, wherein the first and second magnetic switch portions are an actuatable portion and magnet, respectively.

8. A work vehicle, as set forth in claim 5, wherein the first magnetic switch portion is connected to the carriage at a location sufficient for said switch portion being opposite the second magnetic switch portion at open position of the movable floor of the scraper.

* * * * *